United States Patent [19]

Korkowski

[11] Patent Number: 4,541,314

[45] Date of Patent: Sep. 17, 1985

[54] POWER DRIVEN HAND TOOL

[76] Inventor: Richard Korkowski, 16 Wilkens Dr., Piscataway, N.J. 08854

[21] Appl. No.: 583,049

[22] Filed: Feb. 23, 1984

[51] Int. Cl.[3] ..... B25B 13/00

[52] U.S. Cl. ..... 81/58.1; 81/436

[58] Field of Search ..... 81/58.1, 436, 441

[56] References Cited

U.S. PATENT DOCUMENTS

| | | | |
|---|---|---|---|
| 1,479,506 | 1/1924 | Kellemen | 81/436 |
| 1,979,460 | 11/1934 | Forsberg | 81/436 |
| 2,141,072 | 12/1938 | Velepec | 81/436 |
| 2,329,398 | 9/1943 | Duffy | 81/436 |
| 2,923,335 | 2/1960 | Joyce | 81/436 |
| 3,288,002 | 11/1966 | Mankovitz | 81/436 |
| 4,212,336 | 7/1980 | Smith | 81/58.1 |
| 4,356,852 | 11/1982 | Smith | 81/58.1 |

*Primary Examiner*—James L. Jones, Jr.

*Attorney, Agent, or Firm*—Omri M. Behr

[57] ABSTRACT

The invention concerns a manually power driven screwdriver, awl, nutdriver or the like having a handle shaped and dimensioned on its external circumferential surface to be mated with and driven by a conventional female ratchet or socket. Great torque and axial pressure may be applied via the power driven tool, facilitating the removal of frozen bolts, nuts, screws, etc.

3 Claims, 16 Drawing Figures

POWER DRIVEN HAND TOOL

BACKGROUND OF THE INVENTION

The invention relates to a tool such as a screwdriver, nut driver or the like having a handle with an external surface modified to mate with and be driven by a ratchet mechanism.

A common experience to hand tool operators is the difficulty in loosening rust-frozen screws, bolts or nuts. Typically, to loosen nuts and bolts, a standard socket, driven by a manually operated ratchet tool, is employed. MacNeill proposed in U.S. Pat. No. Des. 207,125 a ratchet tool which is apparently adapted to receive a square-holed socket at the end of its shank. As to drivers for screws, Bakeman in U.S. Pat. No. Des. 128,609 shows a screwdriver bit which is apparently inserted into a standard socket to be driven thereby. Another screwdriver bit is disclosed by Magnus in U.S. Pat. No. Des. 150,800 wherein the bit includes a square hole for receiving a shank of MacNeill, it seems. As bits, neither the Magnus or Bakeman devices include handles for manual operation and are useful only in conjunction with a driven tool. Roberts, et al teaches in U.S. Pat. No. 3,475,999 a ratchet hand tool mechanism including a shaft having a square socket into which a screwdriver bit is inserted. The shaft rotates within the handle to eliminate the necessity of a user changing his grip on the tool handle. In U.S. Pat. No. 4,356,852 to Smith, a screwdriver is disclosed wherein the handle end has a well for receiving a torque producing socket wrench drive. The drive engages the screwdriver shank within the well such that the torque is transmitted directly to the shank.

SUMMARY AND OBJECTS OF THE INVENTION

The invention involves a screwdriver, awl, nutdriver or the like having a handle with an external surface modified to mate with and be driven by a ratchet tool. As designed the invention allows the simultaneous application of an axial pressure and torque in a manner that greatly facilitates the loosening of rust-frozen bolts, nuts or screws.

The handle in one embodiment is provided with a plurality of surfaces running the entire length of the handle. The preferred six or twelve-sided handle may be engaged by a conventional twelve-point socket of the type used to turn hexagonal nuts or bolts. A rubber hand-grip may be slipped over the handle covering a major portion thereof provided a sufficient length of the handle is exposed for mating with the socket. Another embodiment of the invention involves a handle with a multi-surfaced end opposite the tool shank. The distal end of the handle only is surfaced for mating with a socket or ratchet driver. A normal grip is shaped or formed along the remaining handle length. Alternately, the six or twelve-sided portion may be that end of the handle secured to the tool shank. The invention is also realized by a multi-tiered handle wherein portions of the handle have various shapes. For instance, the handle distal end may have twelve surfaces, the middle may include a typical grip, and the handle shank end may comprise six faces and have a diameter less than the distal end. Features of the different embodiments are somewhat interchangeable as discussed in greater detail below.

An object of the invention is to provide a tool of simple construction which can be inexpensively manufactured.

A further object is to realize a manually operated tool with which a large axial pressure and great torque can be simultaneously generated;

Another object is to furnish a tool with a handle having various shapes, enabling use of the tool with different sized ratcheting devices.

BRIEF DESCRIPTION OF THE FIGURES

FIG. 4*b* is an end view of the FIG. 4*a* device.

DETAILED DESCRIPTION OF THE INVENTION

Figure 1A:
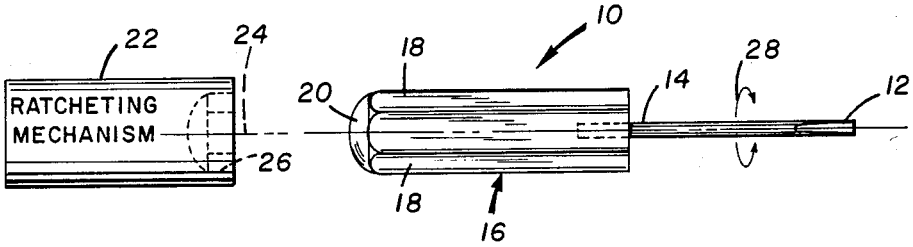
FIG. 1*a* shows an embodiment of the invention wherein the length of the handle is surfaced.
Figure 1B:
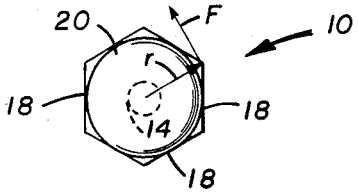
FIG. 1*b* is an end view of the FIG. 1*a* device.

FIG. 1*a* shows a hand tool 10, which as evidenced by the blade 12, is a typical screwdriver. The blade 12 is formed at the end of a shank 14, the shank 14 being attached in a known manner to an elongated handle 16. As viewed in FIG. 1*a*, three visible faces 18 extend the length of the handle 16 except for the rounded end 20 of the handle 16. Three more faces, obviously not visibly in this figure, extend along the back of the handle 16. A ratcheting mechanism is shown at 22 and comprises a conventional ratchet drive tool or ratcheting socket head for instance. The ratcheting mechanism 22 is moved along axis 24 until the handle 16 is mated therewith, the six faces 18 being engaged by a corresponding recess 26 in the ratcheting mechanism 22. Conventional operation of the ratcheting mechanism 22 causes the hand tool 10 to rotate about axis 24 in a clockwise or counter-clockwise fashion 18, as desired. An end view of the hand tool 10 is provided in FIG. 1*b* wherein the six faces 18 are readily apparent. The six faces 28 form a circumferential surface around the handle 16 that is engaged by the ratcheting mechanism recess 26. Because the recess 26 engages the external faces 18, a relatively large moment are "r" is available that is only limited by the full diameter of the handle 16. Thus, if a constant force "F" is applied to the external surface of the handle 16 via the ratcheting mechanism 22, a large torque results ($Tqu=r\times F$). Obviously when the same constant force "F" is applied to prior art hand tools which do not utilize a maximum moment arm, as is realized in the present invention, less torque is generated. Thus, an individual may be able to free rust-frozen bolts that would be impossible to loosen with other devices when exerting maximum physical effort.

Another important feature and advantage of the invention now becomes apparent. When a screwdriver is turned by hand the blade frequently slips from the screw head slot unless adequate pressure is directed along the longitudinal axis of the screwdriver. The tighter the screw, the greater the axial pressure must be to insure non-slip of the blade, otherwise injury to the tool operator may occur. However, a tool incorporating the features of the present invention will not slip quite as readily from an element which is being driven thereby. While a first hand of the operator activates the ratcheting mechanism 22, the second hand may apply a downward pressure along the longitudinal axis of the tool 10 via the handle 16. The first hand may also provide additional axial pressure and the second hand may also restrain the tool from becoming misaligned with the driven element.

Figure 2A:
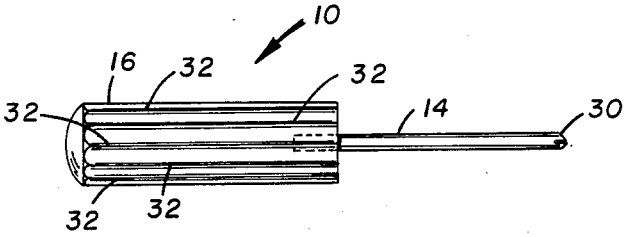
FIG. 2*a* is a variation of the FIG. 1*a* embodiment.
Figure 2B:
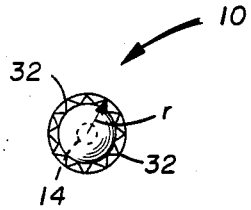
FIG. 2*b* is an end view of the FIG. 2*a* device.

FIG. 2 shows a hand tool 10 which is a variation of the FIG. 1*a* embodiment. The phillips head 30 is attached to the handle 16 via the shank 14. A phillips head 30 is shown merely to illustrate that the particular tool head (screw blade, phillips blade, etc.) is of no consequence with respect to the novelty and advantage of the power driven tool described herein. As embodied in FIG. 2*a*, the handle 16 is provided with twelve surfaces 32, corresponding to the twelve-pointed recess commonly found in ratchet driven sockets. Each of the twelve surfaces 32 engage a single point of such a socket recess. FIG. 2*b* shows an end view of handle 16, wherein the shape of the twelve surfaces 32 is more clearly seen. A cross section of the handle 16 would reveal a star-shaped surface with twelve points. However, each surface 32 need not terminate in a defined edge. The handle 16 may be designed with a cross section that resembles a gear having trapezoidal teeth, provided the surface 32 are dimensioned to be received by a twelve-pointed socket recess. Again, the surfaces 32 extend the length of the elongated handle 16 and a large movement arm "r" is available in that the full radius of the handle 16 is utilized.

Figure 3A:
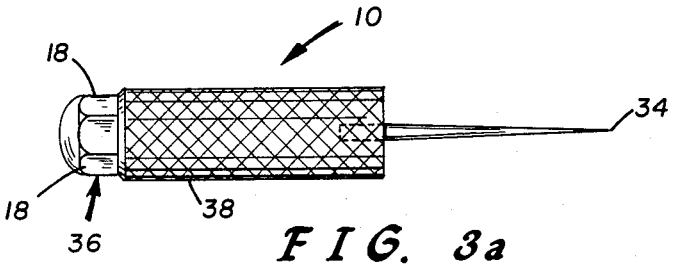
FIG. 3*a* portrays an embodiment wherein the distal end of the handle is surfaced.
Figure 3B:
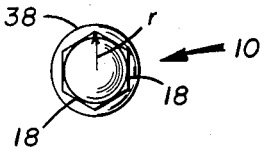
FIG. 3*b* is an end view of the FIG. 3*a* device.

In FIG. 3*a*, another embodiment of the invention is portrayed to which the general principals of the FIG. 1*a* embodiment are applicable. Here, the hand tool 10 comprises an awl 34 instead of a standard or phillips screwdriver as discussed above. The handle 16 at it distal end 36 is shaped to include six surfaces 18, the remainder of the handle length comprising a grip 38 which is grasped by the operator when using the hand tool 10. In this case, the ratcheting mechanism is slipped onto the distal end 36 to engage the six surfaces 18. The grip 38 is presented merely for the convenience of the operator and does not interact with the ratcheting mechanism 22. The end view of the FIG. 3*a* handle 16 is seen in FIG. 3*b*. The grip 38 has a diameter slightly larger than that of the distal end 36, merely as a matter of illustration and may be of the same diameter if desired. The moment arm "r" available to the ratcheting mechanism 22 is measured from the longitudinal axis to the surfaces 18. See FIG. 3*b*.

Figure 4A:
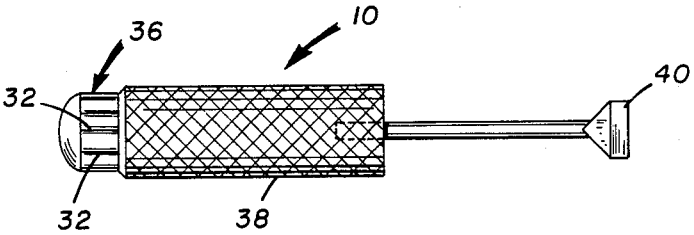
FIG. 4*a* is a variation of the FIG. 3*a* embodiment.
Figure 4A:
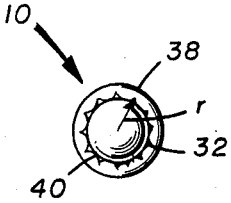

The FIG. 4*a* version concerns a nut driver which incorporates a distal end 36 including twelve surfaces 32 adjacent to the grip 38. As mentioned with respect to the FIG. 2*a* variation, the twelve surfaces 32 are engaged by a twelve-point recess of a ratchet driven socket, however, at the distal end 36 only. Also, the surfaces 32 need not present a sharp edge, but may have a substantially trapezoidal cross-section. The FIG. 4*a* handle 16 is viewed from its end in FIG. 4*b* where the moment arm "r" is evident.

Figure 5A:
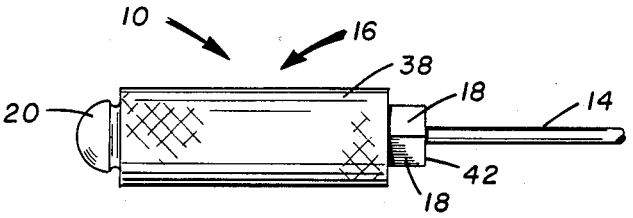
FIG. 5*a* portrays another embodiment wherein the handle is surfaced where the handle adjoins the tool shank.
Figure 5B:
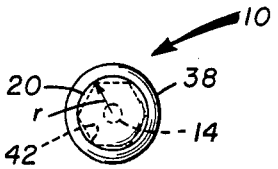
FIG. 5*b* is an end view of the FIG. 5*a* device.

The FIG. 5*a* embodiment involves a hand tool 10 comprising a screwdriver, awl, nut driver, etc. wherein the handle 16 comprises a grip 38 except at the end secured to shank 14. The shank end 42 of the handle 16 has a six-sided surface 18 for engagement by a ratcheting mechanism of the type generally disclosed in U.S. Pat. No. 3,475,999 to Roberts, et al, for instance. FIG. 5*b* reveals the corresponding moment arm "r" in an end view of the FIG. 5*a* handle arrangement.

Figure 6A:
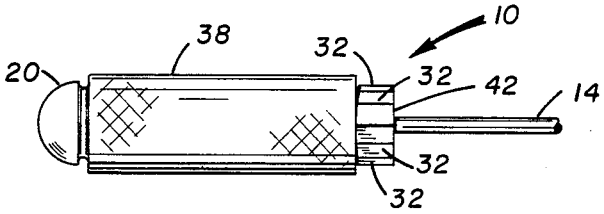
FIG. 6*a* is a variation of the FIG. 5*a* embodiment.
Figure 6B:
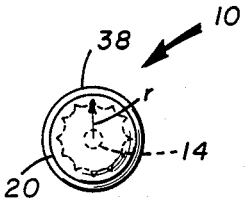
FIG. 6*b* is an end view of the FIG. 6*b* device.

In FIG. 6*a*, the shank end 42 of handle 16 is twelve sided (32), while the moment arm "r" is indicated in FIG. 6*b*. It is believed that in view of the discussion with respect to the prior embodiments, the advantageous features of the variation portrayed in FIGS. 6*a* and 6*b* are apparent and need not be detailed further. The aspects of the invention as described concerning FIG. 5*a* are generally applicable.

Figure 7A:
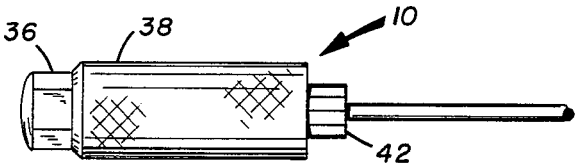
FIG. 7*a* shows an embodiment wherein the handle distal and shank ends are surfaced.
Figure 7B:
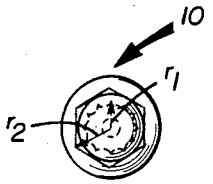
FIG. 7*b* is an end view of the FIG. 7*a* device.

FIG. 7*a* depicts a hand tool 10 which incorporates a handle 16 with a grip 38 separating a six-surfaced distal end 36 and a twelve-sided shank end 42. Thus, the hand tool 10 can be driven via either handle end (36,42) by either of two different ratcheting drivers, whichever is available to the operator. End view 7*b* shows the two moment arms "$r_1$", and "$r_2$" which may be utilized.

Figure 8A:
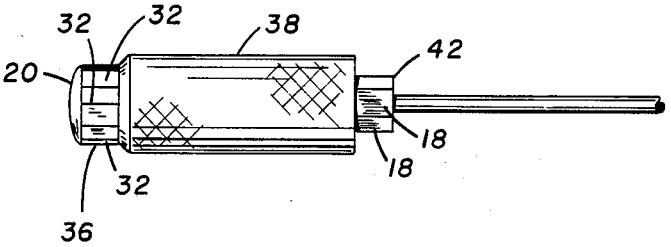
FIG. 8*a* is a variation of the FIG. 7*a* embodiment.
Figure 8B:
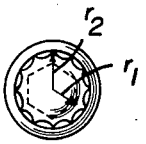
FIG. 8*b* is an end view of the FIG. 8*a* device.

Conversely, FIG. 8*a* portrays a distal end 36 with twelve surfaces 32 and a shank end 42 with six surfaces 18 and a grip 38 therebetween to facilitate engagement with various ratcheting mechanisms 22. The moment arms "$r_1$" and "$r_2$" are shown in FIG. 8*b*.

Other modifications are apparent to one skilled in the art which do not depart from the spirit of the invention. The described embodiments are therefore considered to be only illustrative and not restructive; the scope of the invention being defined by the appended claims.

What is claimed is:

1. A hand tool, power driven by a ratcheting mechanism, the hand tool comprising in combination:

a shank having a longitudinal axis;

an elongated cylindrical handle having a rounded distal end, a shank end to which the shank is attached, a first circumferential surface of smaller diameter than cylindrical handle with a plurality of faces at the distal end of the handle and a second circumferential surface of smaller diameter than cylindrical handle with a plurality of faces at the shank end of the handle, a ratcheting mechanism engagable with said plurality of faces, wherein the ratcheting mechanism engages the hand tool via the plurality of faces for driving the hand tool about the longitudinal axis of the shank, said ratcheting mechanism being so positioned that the rounded distal end of the handles protrudes there through.

2. A hand tool as defined in claim 1, wherein the plurality of faces comprise at least six faces which engage the ratcheting mechanism.

3. A hand tool as defined in claim 2, wherein the plurality of faces comprises at least twelve faces which engage the ratcheting mechanism.

* * * * *